United States Patent [19]

Broadwith et al.

[11] 4,421,084

[45] Dec. 20, 1983

[54] FUEL INJECTION PUMPING APPARATUS

[75] Inventors: Brian E. Broadwith, Burnham on Crouch; Robert T. J. Skinner, High Wycombe, both of England

[73] Assignee: Lucas Industries Limited, Birmingham, England

[21] Appl. No.: 887,468

[22] Filed: Mar. 17, 1978

[30] Foreign Application Priority Data

Feb. 21, 1978 [GB] United Kingdom ..... 6750/78

[51] Int. Cl.[3] ..... F02M 59/20

[52] U.S. Cl. ..... 123/365; 123/387; 123/502

[58] Field of Search ..... 123/140 FG, 140 J, 139 AM, 123/139 AL, 139 AP, 139 AQ, 365, 387, 388, 502, 368

[56] References Cited

U.S. PATENT DOCUMENTS

| | | | |
|---|---|---|---|
| 3,363,568 | 1/1968 | Evans | 123/139 AL |
| 3,499,426 | 3/1970 | Bailey | 123/140 FG |
| 3,658,040 | 4/1972 | Vuaille et al. | 123/140 J |
| 3,968,779 | 7/1976 | Davis | 123/140 FG |
| 4,014,305 | 3/1977 | Skinner et al. | 123/139 AQ |
| 4,041,920 | 8/1977 | Skinner | 123/139 AM |

FOREIGN PATENT DOCUMENTS

| | | | |
|---|---|---|---|
| 1186265 | 1/1965 | Fed. Rep. of Germany | 123/140 FG |
| 645993 | 11/1950 | United Kingdom | 123/140 J |

*Primary Examiner*—Charles J. Myhre
*Assistant Examiner*—Magdalen Moy

[57] ABSTRACT

A fuel injection pumping apparatus includes a governor which controls the size of an orifice through which fuel is supplied to an injection pump to determine the amount of fuel supplied by the pump to an associated engine. The governor includes a piston which at one end is subjected to fuel pressure and which bears at its other end against a spring connected in series with a spring. The spring is weaker than the spring so that at idling speed it is the spring which balances the force acting on the piston. Manually operable means is provided to effect movement of an abutment disposed between the springs, the spring acting to determine the maximum speed of the associated engine. When the engine has been started from cold, it is desirable to provide additional fuel to enable the engine to idle properly and for this purpose a device represented by the arrow, moves the end of the spring remote from the spring and this provides a temporary increase in the amount of fuel supplied at idling speeds.

8 Claims, 3 Drawing Figures

FUEL INJECTION PUMPING APPARATUS

This invention relates to a fuel injection pumping apparatus for supplying fuel to a compression ignition internal combustion engine and of the kind comprising an injection pump operable, in use, to deliver fuel at high pressure to the injection nozzles of the associated engine and in timed relationship therewith, the apparatus including a fuel control member movable to vary the amount of fuel supplied by the injection pump, a timing control member movable to vary the timing of delivery of the fuel by the injection pump and governor means including speed responsive means which is responsive to the speed of the associated engine, said governor means comprising a first spring which at one end is subjected to the force exerted by said means and which at its other end engages an adjustable abutment, a second spring positioned between said adjustable abutment and a support member, the strength of said second spring being less than the strength of the first spring, said second spring being operative under engine idle conditions and forming with said means an idle governor, said first spring being operative at higher engine speeds and forming with said means a maximum speed governor, and manually operable means which can be engaged with said adjustable abutment when it is required to increase the amount of fuel supplied by the apparatus.

The governor portion of the apparatus set out above is known in the art as a two-speed governor since it controls the idling speed and also the maximum speed of the engine. The supply of fuel at speeds between idling and maximum speed is determined by the operator by movement of the adjustable abutment which at idling speeds is free to move under the action of said second spring and said means.

It has been found in some applications that the associated engine does not idle properly when started from cold and this is thought to be due not to the apparatus but to problems associated with the engine.

The object of the present invention is to provide an apparatus of the kind specified in a form in which the idling speed can be temporarily adjusted from the exterior of the apparatus.

According to the invention, an apparatus of the kind specified comprises means operable from the exterior of the apparatus for effecting an increase in the force exerted by said second spring whereby the idling speed of the engine is increased.

According to a further feature of the invention, further means is provided which is operable in conjunction with said means to ensure that the timing control is moved to a position in which the timing of the delivery of fuel is advanced.

One example of a fuel pumping apparatus in accordance with the invention will now be described with reference to the accompanying drawings, in which.

Figure 1:
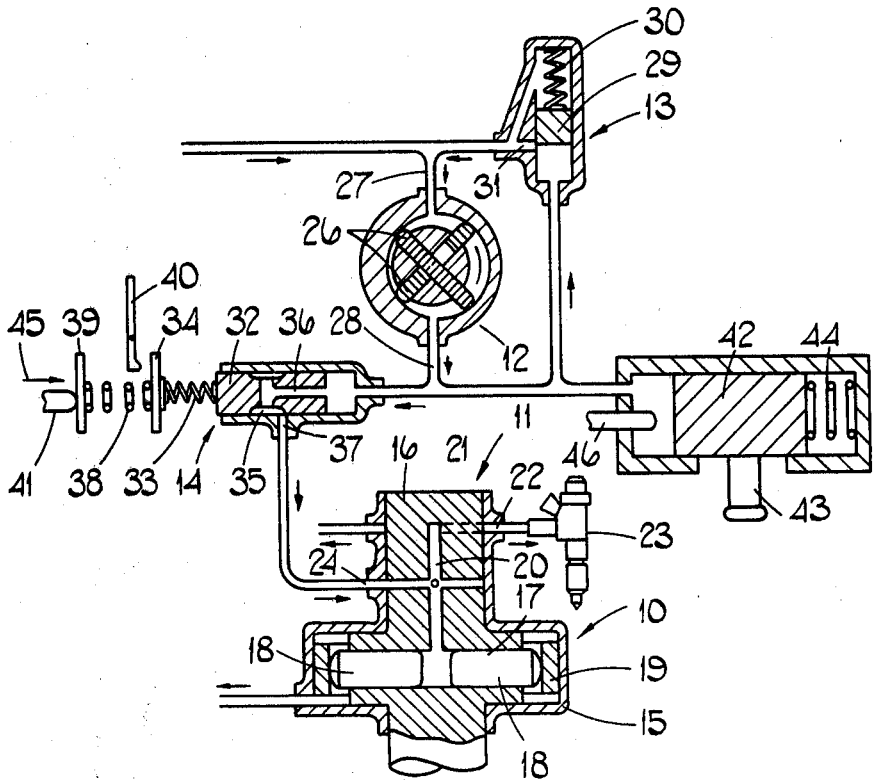
FIG. 1 is a diagrammatic representation of the apparatus.

With reference to FIG. 1 of the drawings, the apparatus comprises an injection pump 10, a rotary distributor 11, a feed pump 12, a regulating valve 13 and a throttle and governor assembly 14.

The injection pump, distributor and feed pump are contained in a common housing which is generally indicated at 15, the distributor comprising a distributor member 16 which is mounted for rotation within the housing 15 and which in use, is driven in timed relationship with the associated engine. An enlarged portion of the distributor member is provided with a transverse bore 17 which accommodates a pair of pumping plungers 18 which are moved inwardly as the distributor member rotates, by cam lobes formed on the internal peripheral surface of an annular cam ring 19, which is located within the housing.

The injection pump is constituted by the cam ring 19 and the plungers 18.

The fuel delivered by the injection pump during the injection strokes is supplied to a longitudinal passage 20 formed in the distributor member and which at its end remote from the pumping chamber of the injection pump communicates with a delivery passage shown in dotted outline and referenced 21. The delivery passages register in turn as the distributor member rotates, with a plurality of outlets 22 formed in the housing and which, in use, are connected to injectors 23 respectively (only one of which is shown) mounted on the associated engine.

Fuel is supplied to the injection pump along part of the aforesaid passage 20 by way of an inlet port 24 formed in the housing and communicating in turn with inlet passage 25 which communicate with the passage 20.

Fuel is supplied to the inlet port 24 by the feed pump 12 which is of the constant displacement type and as shown, comprises two vanes 26 carried by the distributor member and co-operating at their outer ends, with the internal peripheral surface of a pumping chamber which is eccentrically disposed relative to the axis of rotation of the distributor member. The chamber has an inlet 27 which is connected to a source of fuel and an outlet 28 which communicates with the inlet port 24 by way of a throttle which forms part of the throttle and governor assembly 14.

The outlet pressure of the feed pump is controlled by the regulating valve 13. The method of control is to spill a portion of the fuel pumped by the pump from the outlet thereof to the inlet. The regulating valve comprises a cylinder in which is located a plunger 29 exposed at one end to the outlet pressure of the feed pump and engaged at its other end, by a coiled spring 30. The plunger is arranged to uncover to a greater or lesser extent a port 31 formed in the wall of the cylinder and which communicates with the inlet of the feed pump. Moreover, the portion of the cylinder which contains the spring 30 also communicates with the inlet of the feed pump. The dimensions of the feed pump are such that it always supplies more fuel than is required to be supplied to the engine and as the speed at which the distributor member is driven increases, more fuel will need to be spilled between the outlet and inlet. As a result the plunger 29 must be moved against the action of the spring 30 to open the port 31. Such movement requires an increasing force and as a result the outlet pressure of the feed pump increases as the speed of operation of the associated engine increases.

The throttle and governor assembly comprises a piston 32 which at one end is subjected to the outlet pressure of the feed pump and which at its other end is contacted by a first spring 33. The other end of the spring 33 engages an adjustable abutment 34. A further spring 38 has one end engaging the abutment 34 and its other end bearing against a support member 39. The force exerted by the spring 38 is less than that exerted by the spring 33 which may be a preloaded spring. A manually operable member 40 is provided which can be engaged with the abutment 34 to impart by way of the spring 33, movement to the piston 32. At idling speeds, however, the member 40 is clear of the abutment 34, so that the second spring 38 is operative and opposes movement of the piston 32 under the action of the output pressure of the feed pump. A fixed stop 41 is provided for engagement by the support 39.

The piston 32 is provided with a peripheral groove 35 which is in constant communication with the outlet 28 of the feed pump by way of a passage 36 formed in the piston. Formed in the wall of the cylinder in which the piston is mounted is a port 37 which is in constant communication with the aforesaid inlet port 24. The disposition of the groove 35 and the port 37 is such that as the output pressure of the feed pump increases, indicative of an increased engine speed, the piston is moved to reduce the extent of communication between the groove 35 and the port 37. These two components constitute the throttle. If the manually operable means 40 is engaged with the abutment 34, the piston 32 is moved in a direction to increase the effective size of the port 37 and as a result more fuel flows to the associated engine. If, on the other hand, the member 40 is clear of the abutment 34, then it is the force exerted by the spring 38 which is balanced against the force acting on the piston 32 due to the output pressure of the feed pump, which determines the size of the port 37. In this manner the idling speed of the associated engine is controlled. When the manually operable means 40 is engaged with the abutment 34 as the piston 32 is moved to increase the size of the port 37, the engine will gradually accelerate until a point will be reached at which the force exerted by the output pressure of the feed pump acting on the piston 32 is sufficient to overcome the preload of the spring 33. When this occurs the piston 32 will be moved against the action of the spring to reduce the effective size of the port 37 and hence reduce the amount of fuel supplied to the engine. In this manner, the maximum speed of the associated engine is controlled.

The apparatus also includes a fluid pressure operable piston 42 which is mounted within a cylinder. The piston 42 carries a lateral peg 43 which is engaged within a recess (not shown) formed in the cam ring 19. The piston 42 is loaded by a coiled compression spring 44 and is urged in the direction against the action of the spring by fuel under pressure derived from the outlet 28 of the feed pump. The action of the piston 42 is to advance the delivery of fuel to the engine as the engine speed increases.

For starting purposes an excess of fuel is supplied by the apparatus to the associated engine. The way in which the excess fuel is obtained is not shown but in any event, once the engine has started the supply of excess fuel is terminated to avoid excessive smoke and also excessive engine speed. It has been found, however, that with some applications the associated engine when it is started from cold, does not idle satisfactorily until it has become warm. This problem is overcome by moving the support member 39 away from the stop 41 in the direction to slightly increase the force exerted by the spring 38. An arrow 45 is indicated to represent the device which is engageable with the support 39 to effect movement of the support away from the stop 41. It has also been found desirable to advance the timing of delivery of fuel whilst the idling speed has been adjusted as described. For this purpose a positioning member 46 is provided which can be moved to engage the piston 42 and to displace same a predetermined amount against the action of the spring 44. The positioning member 46 and the device 45 are operated in synchronism.

Figure 2:
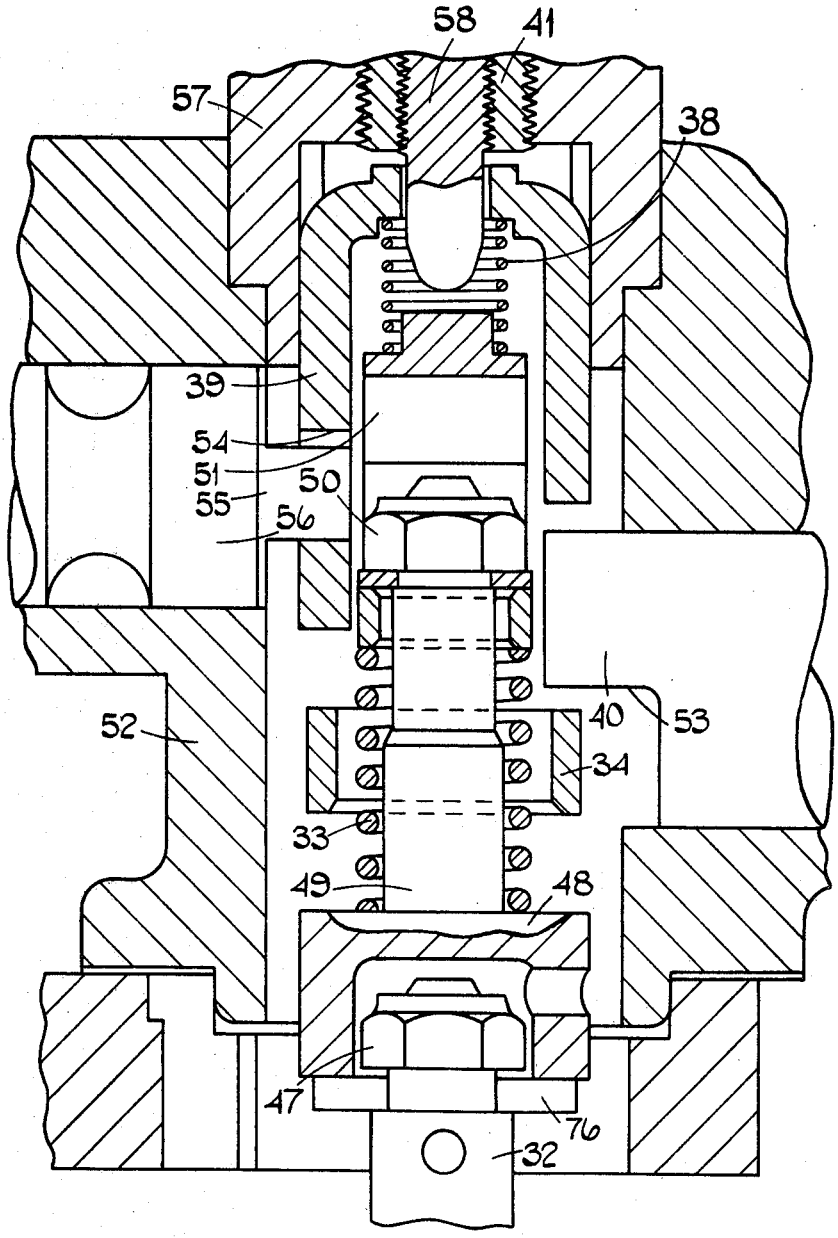
FIG. 2 is a sectional side elevation of a portion of the apparatus.

Turning now to FIG. 2, this shows in sectional side elevation the construction of the governor mechanism and a portion of the throttle. Wherever possible, like reference numerals are utilised.

The piston 32 has a reduced portion at its upper end and carries an annular washer 76 which is retained by means of a nut 47 mounted on a screw-threaded portion of the piston 32. Engaging against the washer 46 is the rim of a cup-shaped portion 48 which is integrally formed with a stepped rod 49. At its upper end the rod 49 is provided with a screw-threaded portion engaged by a nut 50 and which retains a stirrup 51 relative to the stepped rod. The adjustable abutment 34 is of a complex shape and has a wider portion which surrounds the spring 33 and a narrower portion which is engaged by the spring 33. Moreover, the spring 33 urges the narrower portion of the abutment into engagement with the stirrup 51. The spring 33 engages the cup-shaped portion 48 and the spring 33 is preloaded by virtue of the fact that it is sandwiched between the portion 48 and the adjustable abutment. The adjustable abutment is mounted for sliding movement in a housing 52 which provides support for the manually operable member 40 which is in the form of an angularly movable shaft having an eccentric portion 53 which is engageable with the wider portion of the adjustable abutment 34. When the manually operable member 40 is moved angularly, the portion 53 engages the adjustable abutment 34 and through an intermediary of the spring 33, the cup-shaped portion portion 48 and the piston 32 are moved downwardly. Only when the force due to fluid pressure acting on the piston 32 is sufficient to overcome the preload of the spring, does the piston, the cup-shaped portion 48 and the rod member 49, move upwardly against the action of the spring 33 and relative to the adjustable abutment 34. In the engine idle position in which the manually operable member 40 is shown, a clearance exists between the portion 53 and the adjustable abutment 34.

At its upper end of the stirrup 51 is engaged by the spring 38. The other end of the spring engages the support 39 which is of U-shaped form and again is mounted for sliding movement within the housing 52. One limb of the support is longer than the other and is provided with an aperture 54 in which is located a peg 55 which constitutes an eccentrically disposed extension of a shaft 56 mounted for angular movement within the housing 52. The shaft 56 is moved to the position shown to increase the idling speed and in so doing it moves the support 39 downwardly so as to increase the force exerted by the spring 38. The support 39 can engage the stop 41 which is adjustable rotated within a cap 57 secured within the housing 52. When the shaft 56 is moved angularly the support 39 contacts the stop 41 to provide the normal idling speed of the associated engine. The stop 41 also carries an additional stop 58. This forms no part of the invention but it constitutes an anti-stall stop which limits the movement of the piston 32 under the action of the output pressure of the feed pump. The stop 58 therefore determines the minimum rate of fuel which is supplied to the engine.

Figure 3:
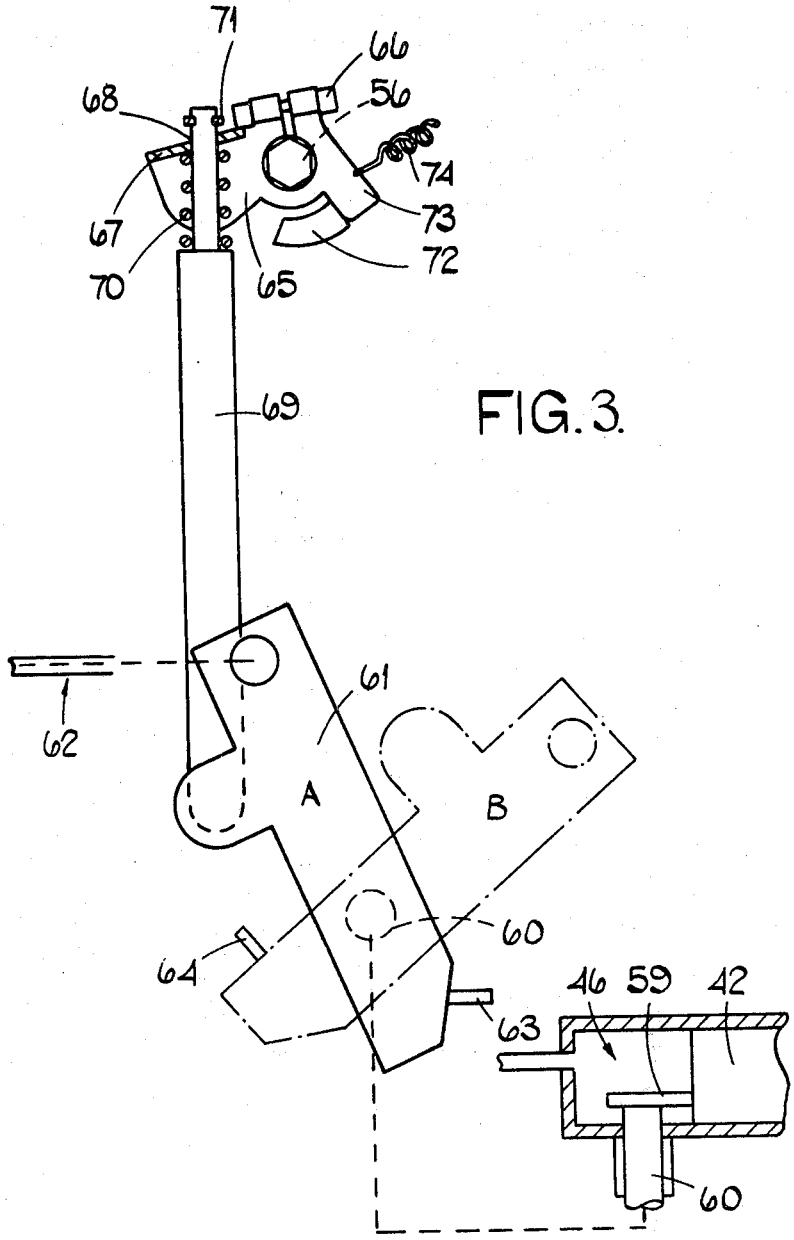
FIG. 3 is a diagrammatic representation of a linkage forming part of the apparatus.

Referring now to FIG. 3, which shows a diagrammatic representation of the linkage which interconnects the shaft 56 with the manually operable control, and also the device 46 which positions the timing piston 42. At the lower portion of FIG. 3, the device 46 is shown as a cam 59 engageable with the end of the piston 42 and mounted on an angularly movable shaft 60. The shaft 60 extends from the housing and is non-rotatably secured to a lever 61. One arm of the lever has at its end a clamp for the inner member of a Bowden cable 62 coupled to a manually operable control. The lever 61 is shown in two positions in the drawing identified as positions A and B. A pair of stops 63, 64 are provided to limit the angular movement of the lever 61 the stop 63 being contacted when the lever is in position A.

A further lever 65 is provided and this is adjustably mounted by means of a pinch bolt 66, upon the shaft 56. The lever 65 has an arm which defines a web 67 facing the lever 61 and in which is formed an aperture 68. Extending through the aperture 68 is one end of a link 69 which is pivotally connected to the lever 61. The link defines an abutment between which and the web 67 is disposed a coiled compression spring 70. Moreover, the free end of the link 69 carries a circlip 71 engageable with the web 67.

The various parts are shown in FIG. 3 in the positions they adopt when increased idling speed has been selected. In other words, the cam 59 engages the piston 42 in order to advance the timing of delivery and the support 39 is moved away from the stop 41. The extent of the movement of the support 39 away from the stop is determined by a stop member 72 which is engaged in this situation, by an extension 73 on the lever 65. Moreover, a weak spring which is shown as a tension spring 74, biases the lever 65 in the anticlockwise direction. The force exerted by the spring 74 is however less than the force exerted by the spring 70.

When the engine has become heated sufficiently to allow normal idling speed, the operator moves the manual control to move the link 69 towards the position B. In position A the piston 42 rests on the crest of the cam 59. However, as the lever 61 is moved the force exerted by the spring 44 which acts on the piston 42 tends to assist the movement of the lever 61 to position B and in which it contacts the stop 64. It must be emphasised however, that when the lever 61 is in position B the cam 59 is removed from the piston 42 so that the latter can operate without disturbance by the cam. As the lever 61 is moved towards position B the spring 70 is initially compressed but as the link 69 and lever 61 go over the top dead centre position the spring 70 moves the link through the aperture 68 and the circlip 71 engages with the web 67 to move the lever 65 in the anticlockwise direction. In so doing, the shaft 56 is rotated and the support 39 moves into contact with the stop 41. In the final position the extension 55 is clear of the wall of the aperture 54. Moreover, the lever 65 does not in this position engage the stop 72, the final position of the linkage being determined by the stop 64.

The pinch bolt 66 is provided to enable the normal idling speed and the increased idling speed to be adjusted. Initially the pinch bolt 66 is slackened and the stop 41 is adjusted to provide the correct idling speed for when the engine is warm. The mechanism is then moved to the position shown in FIG. 3 and the shaft 56 is moved angularly by an amount sufficient to provide proper idling when the engine is cold. Following this the pinch bolt is tightened and the mechanism is correctly adjusted.

The apparatus described above utilizes an hydraulic governor which means in effect that the speed signal is provided by fuel pressure acting on the piston 32. The idea is equally applicable to a mechanical governor in which the force is generated by a plurality of weights which move outwardly under the action of centrifugal force.

We claim:

1. A fuel injection pumping apparatus for supplying fuel to a compression ignition internal combustion engine comprising an injection pump operable to deliver fuel at high pressure to injection nozzles of the associated engine, a fuel control member movable to vary the amount of fuel supplied by the injection pump, a timing control member movable to vary the timing of delivery of the fuel by the injection pump, and governor means including speed responsive means which is responsive to the speed of the associated engine, said governor means comprising a first spring having one end thereof subjected to a force exerted by said speed responsive means, an adjustable abutment engaging the other end of said first spring, a second spring, a support member, said second spring being positioned between said adjustable abutment and said support member and having a strength less than the strength of said first spring, said second spring being operative under engine idle conditions and forming with said speed responsive means an idle governor, said first spring being operative at higher engine speeds and forming with said speed responsive means a maximum speed governor, manually operable means engageable with said adjustable abutment to increase the amount of fuel supplied by the apparatus, and means operable from the exterior of the apparatus for effecting an increase in the force exerted by said second spring whereby the idling speed of the engine is increased.

2. A fuel injection pumping apparatus for supplying fuel to a compression ignition internal combustion engine comprising an injection pump operable to deliver fuel at high pressure to injection nozzles of the associated engine, a fuel control member movable to vary the amount of fuel supplied by the injection pump, a timing control member movable to vary the timing of delivery of the fuel by the injection pump, and governor means including speed responsive means which is responsive to the speed of the associated engine, said governor means comprising a first spring having one end thereof subjected to a force exerted by said speed responsive means, an adjustable abutment engaging the other end of said first spring, a second spring, a support member, said second spring being positioned between said adjustable abutment and said support member and having a strength less than the strength of said first spring, said second spring being operative under engine idle conditions and forming with said speed responsive means an idle governor, said first spring being operative at higher engine speeds and forming with said speed responsive means a maximum speed governor, manually operable means engageable with said adjustable abutment to increase the amount of fuel supplied by the apparatus, means operable from the exterior of the apparatus for effecting an increase in the force exerted by said second spring whereby the idling speed of the engine is increased, and means operable in conjunction with said means operable from the exterior of the apparatus to ensure that the timing control member is moved to a position in which the timing of delivery of fuel is advanced.

3. An apparatus according to claim 2 in which said timing control member comprises a fluid pressure operable piston located in a cylinder and said further means comprises a cam mounted on a shaft which is angularly movable to cause the cam to engage the piston to position the piston to provide the required timing of the delivery of fuel.

4. An apparatus according to any one of claims 2 or 3, including a stop for determining the position of said support member and therefore the force exerted by said second spring for control of engine idling when the associated engine is hot, said means operable from the exterior of the apparatus acting to move said support member away from said stop to increase the force exerted by said second spring.

5. An apparatus according to claim 4 in which said means operable from the exterior of the apparatus includes an angularly movable shaft.

6. An apparatus according to claim 3, wherein said support member is mounted for slidable movement within a housing, and said means operable from the exterior of the apparatus comprises a second angularly movable shaft engaged with said support member for causing sliding movement thereof.

7. An apparatus according to claim 6, including linkage interconnecting said shafts, said linkage being connected in use to a manually operable control.

8. An apparatus according to claim 7 in which said linkage includes a pair of levers mounted on said shafts respectively and a link extending between the levers, said link forming with one of said levers a toggle mechanism.

* * * * *